United States Patent [19]

Prentice

[11] Patent Number: 4,714,217

[45] Date of Patent: Dec. 22, 1987

[54] KITE LINE TAKE-UP DEVICE

[76] Inventor: Daniel Prentice, 2021 Folsom St., San Francisco, Calif. 94110

[21] Appl. No.: 833,908

[22] Filed: Feb. 26, 1986

[51] Int. Cl.[4] ..... B64C 31/06; B65H 75/40

[52] U.S. Cl. ..... 244/155 R; 244/155 A; 242/96

[58] Field of Search ..... 244/153 R, 155 R, 155 A; 446/30, 31, 32, 33; 242/96; 114/254

[56] References Cited

U.S. PATENT DOCUMENTS

| | | | |
|---|---|---|---|
| D. 165,269 | 11/1951 | Cordell | 244/155 A |
| 2,472,075 | 6/1949 | Hole | 244/155 A |
| 3,138,356 | 6/1964 | McClain | 244/155 A |
| 3,409,255 | 11/1968 | Sada | 244/155 |
| 3,615,064 | 10/1971 | Gellert | 242/96 |
| 3,740,010 | 6/1973 | Curtis | 244/155 |
| 3,746,286 | 7/1973 | Christoffel | 244/155 A |
| 4,014,477 | 3/1977 | Hyun | 242/96 |
| 4,101,090 | 7/1978 | Wait | 242/96 |
| 4,129,273 | 12/1978 | Hill | 244/155 A |
| 4,172,567 | 10/1979 | Post | 242/96 |
| 4,176,806 | 12/1979 | Kwon | 244/155 A |
| 4,278,212 | 7/1981 | Wesley | 242/96 |

FOREIGN PATENT DOCUMENTS

| | | | |
|---|---|---|---|
| 2385422 | 12/1978 | France | 242/96 |

*Primary Examiner*—Sherman D. Basinger
*Assistant Examiner*—Rodney Corl
*Attorney, Agent, or Firm*—Phillips, Moore, Lempio & Finley

[57] ABSTRACT

A take up device for the control of kites by multiple lines includes two control handles removably fixable to an axle such that the control lines, individually affixed to either of the handles may be simultaneously retrieved with the handles affixed to the axle.

17 Claims, 6 Drawing Figures

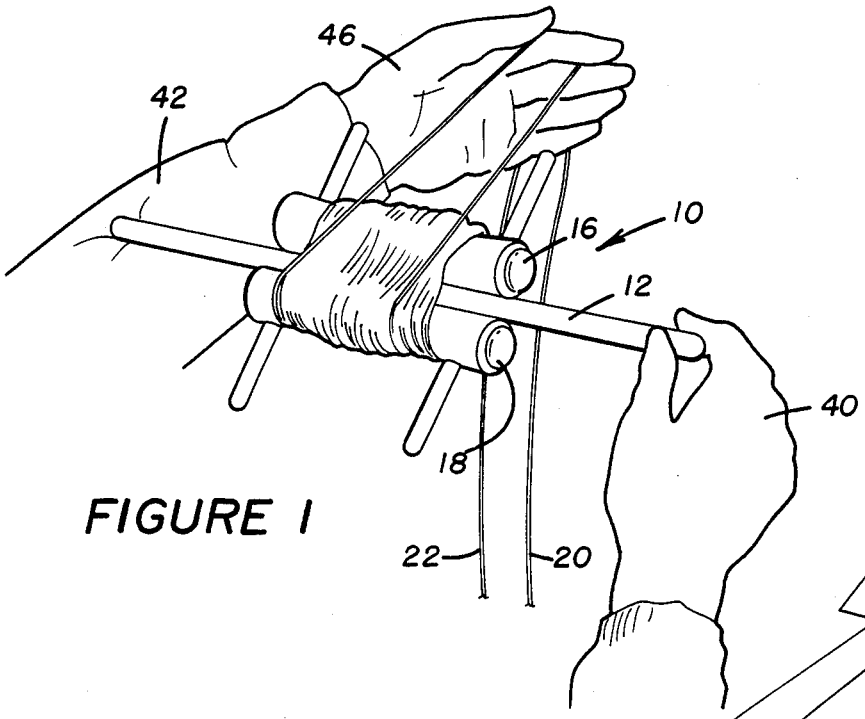
FIGURE 1
FIGURE 2
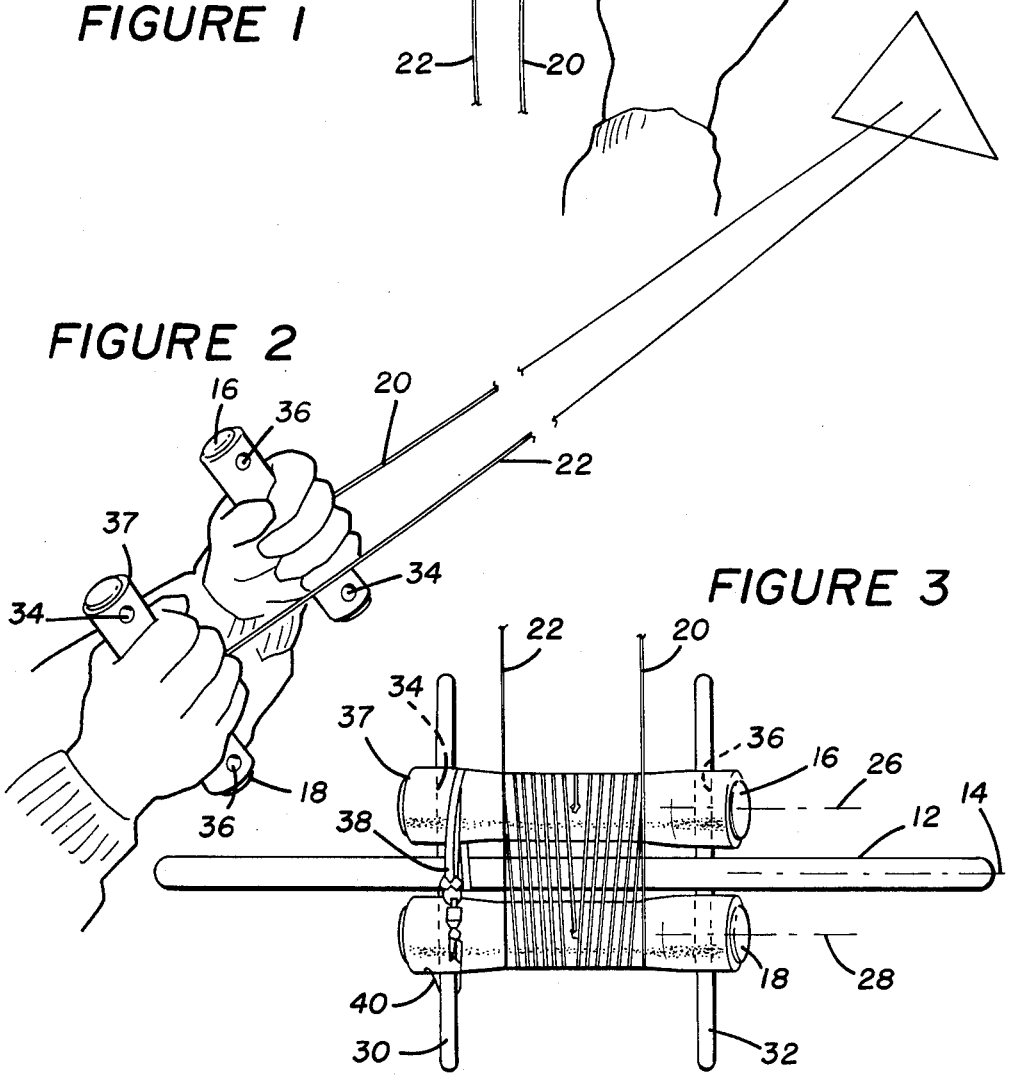
FIGURE 3

FIGURE 5
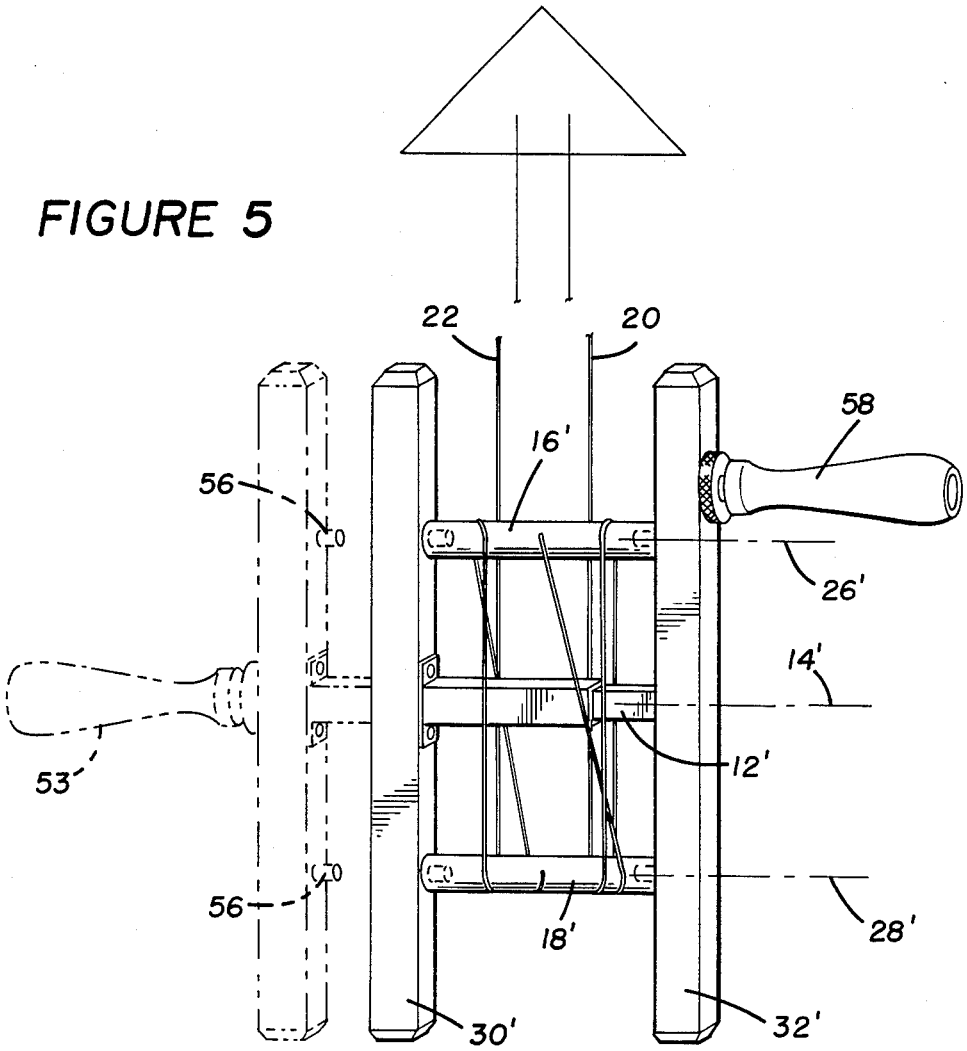
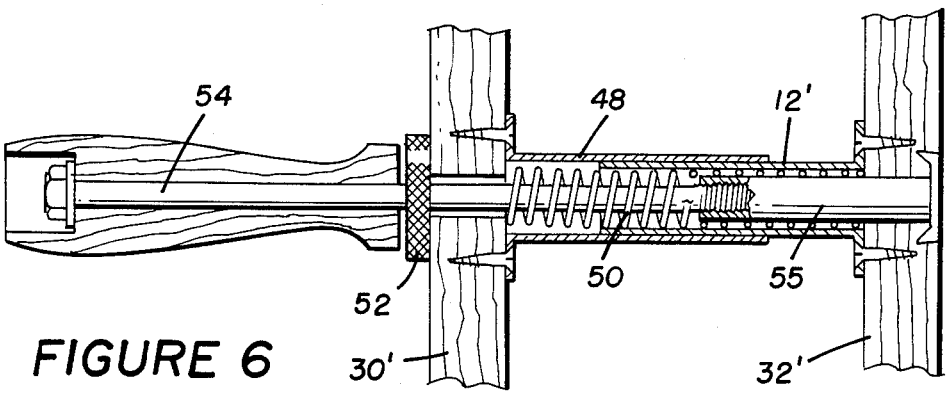
FIGURE 6

KITE LINE TAKE-UP DEVICE

BACKGROUND OF THE INVENTION

In recent years the flying of kites in Western nations has become an adult sport. As is well known, in years past kite flying in most western nations was restricted to the younger ages and generally occurred in the high wind spring days of March and April. Kites of the type used by children generally are relatively uncontrollable in that only a single line is affixed to the kite by a bridle or the like so that the kite flyer is at the mercy of the wind with lift for the kite being created by the wind passing over the airfoil shape of the kite. Further, stability in the kite was generally in the nature of a tail traditionally made of a long string of cotton cloth. All of these single line kites provide an untold amount of enjoyment among children but the lack of control of the kite itself causes interest to wane for the more mature kite flyer. Essentially the only interest left for a kite of this type is for a record height or amount of line utilized to fly the kite.

On the other hand kite flying in the Orient has traditionally been much more sophisticated with adults participating in the sport even to the extent of having competitions. In recent years the advent of sophisticated kite flying has penetrated the Western world and a rather large group of kite flying devotees has developed through the West. What has brought the interest in kite flying to a peak in the United States has been the introduction of control of the kite itself. In order to accomplish this it is necessary to have two or more lines connected to the kite so that the angle of attack of the airfoil formed by the kite may be varied resulting in components of lift other than upperwardly which is the usual effect of the single line kite. For example two lines affixed to the kite can result in relatively sophisticated control of the kite itself. Thus one can "fly" the kite to the right or left or up or down depending upon the tension placed on the respective right or left kite line. In short the kite is flown with two kite lines each controlled by handles with a line running from each handle to the kite. Movement of the handle by the kite flyer is transmitted through the line to the kite itself. When the aspect of the kite is changed relative to the airflow over the kite caused by the natural flow of the wind, the kite will move to relieve the different tensions on the two lines. To move the kite back to the original position the tension on the one line is relieved with tension on the other line increasing. Of course, if an equal amount of tension is provided on both lines then the kite will fly in a manner similar to a single-line kite.

Multi-line kites such as just described are well known in the art. The problem associated with a multi-line kite is the deployment of the two or more lines used to control the kite at the time of launching and also the retrieval of the lines once the kite has landed. Should care not be exercised the lines become tangled and in some instances unusable. With a dual line kite the operator usually is provided with two handles with a line affixed to each handle. Should the operator attempt to wrap the lines around the two handles the two lines will become twisted together and the operator must spend an inordinate amount of time untwisting the rather long control line before the next flight. On the other hand should the operator elect to rotate just the handles about their own axis and perpendicular to the axis of the lines to pick up the lines the retrieval time is excessive and requires either that the kite be firmly fixed so that tension can be maintained on the lines or alternatively a second person is necessary to feed the lines to the operator as the handles are turned about their own axis. It is to be understood that the difficulties described above are reversed upon deployment of the kite line.

Attempts to solve the above described problem generally revolve around dual reels somewhat in the manner of fishing reels and the like. While this may solve the take-up of the lines, it provides a cumbersome arrangement for the kite flyer simply because the duel reels usually must be disconnected while flying a kite with a handle in each hand. In one attempt to overcome the take-up and release of the kite lines, a horizontal reel has been built into a single control device so that the operator is able to control the kite with a single device similar to a tiller bar with the reel in the center portion of the tiller bar.

It is an object of the present invention to overcome the deficiencies described above and in particular to provide removable handles that form a reel that allows rolling up of the kite line without tangling.

It is a further object of this invention to provide a kite line retrieval system that has relatively few moving parts.

It is also an object of this invention to provide a simple fast method for kite line retrieval. It is a further object of the invention to provide a means for securing the retrieved kite line to the device after the windup.

Broadly stated the invention is a control and take-up assembly for use with a multi-line kite and includes an axle, a pair of elongated handles each handle having affixed thereto at least one of the control lines. The device includes a way of removably affixing the elongated handles to the axle such that the axes of the handles are substantially parallel to the axis of the axle and displaced therefrom a distance at least equal to the radius of the axle.

BRIEF DESCRIPTION OF THE DRAWINGS

FIG. 1 is a representation of the invented device during operation thereof;

FIG. 2 is a representation of the device with the kite lines deployed and the kite being controlled by the operator.

FIG. 3 is an elevational view of the preferred embodiment;

FIG. 5 is still a third embodiment of the invention shown in FIG. 3.

FIG. 6 is a detailed view partly in section of the axle of the embodiment shown in FIG. 5.

DETAILED DESCRIPTION OF THE PREFERRED EMBODIMENT

Figure 4:
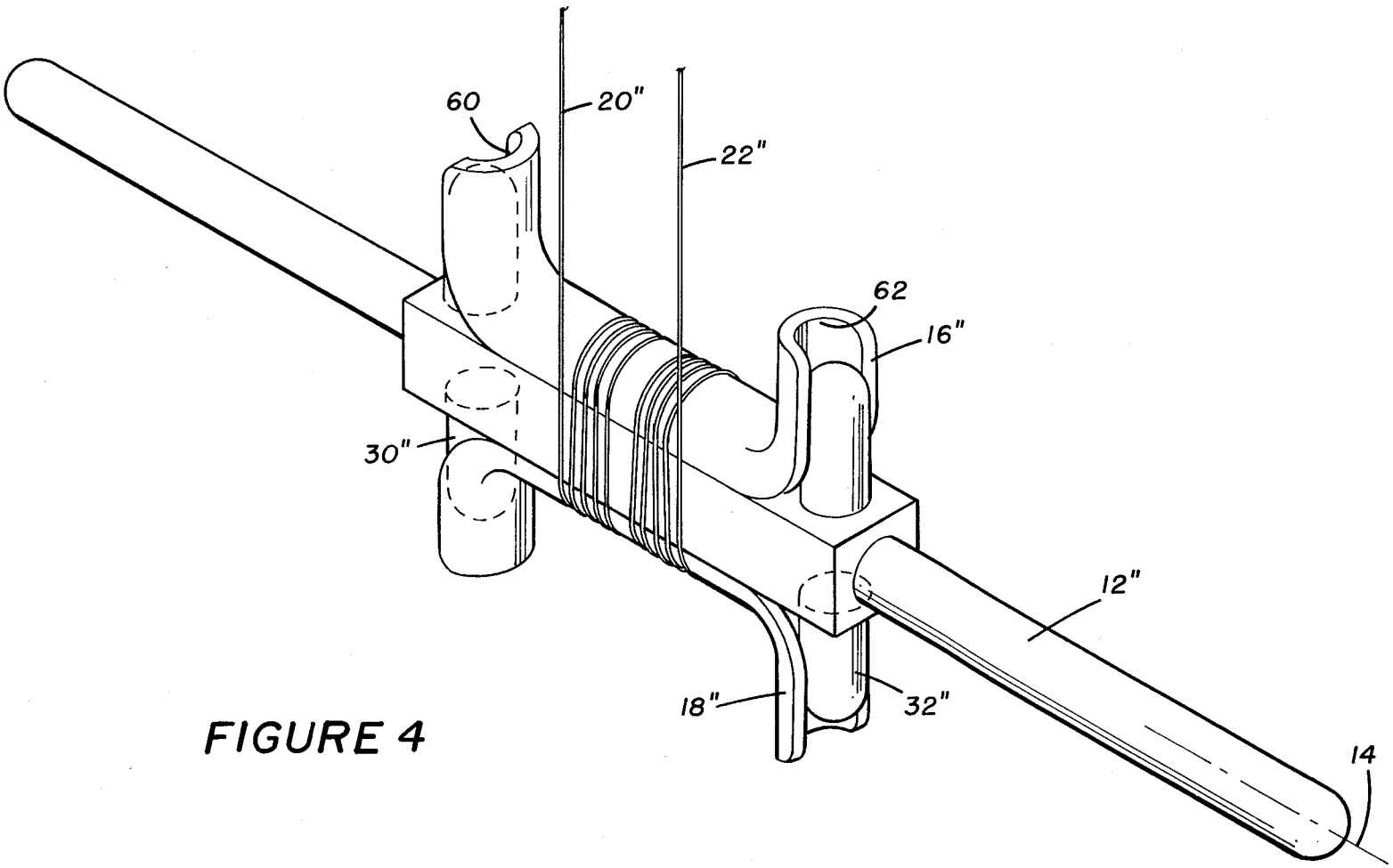
FIG. 4 is an alternate embodiment of the invention shown in FIG. 3.

Referring to FIG. 1, a take-up and control device 10 for the control of lines for kites is shown. This same device is shown in FIG. 3 in its structural form. Device 10 as shown in FIG. 3 consists of an axle 12 having an axis 14. Associated with axle 12 are a pair of elongated handles 16 and 18 each handle 16 and 18 has associated therewith a line 20 and 22 respectively. Lines 20 and 22 as shown in FIG. 2 are usable to control a kite 24 in the conventional manner.

Handle 16 and 18 are associated with axle 12 such that the axis 26 and 28 of the handle 16 and 18 respectively are parallel to and separated from axis 14 a distance at least equal to the radius of axle 12. Mounting of the handle 16 and 18, in the preferred embodiment, is accomplished by first and second elongated rods 30 and 32. Elongated rods 30 and 32 are themselves located in the same plane and in the plane which contains axis 14. In the preferred embodiment as shown in FIG. 3 these elongated rods 30 and 32 may have a circular cross section and ideally would pass through axle 12 extending outwardly therefrom as shown in FIG. 3. Each handle 16 and 18 has a pair of holes 34 and 36 as shown in FIGS. 2 and 3 so that handle 16 or 18 as the case may be can be mounted on the elongated rods 30 and 32 relatively close to the axle 12 as shown in FIG. 3. It may be appropriate to permit the handles to be located relatively remote of axle 12 in which case elongated rods 30 and 32 may have a stepped diameter (not shown) so that handles 16 and 18 are prevented from abutting axle 12 directly.

For convenience, the handles 16 and 18 may have a resilient or foam rubber material 37 surrounding the outer circumference of the handles to facilitate use of the handles as shown in FIG. 2 when flying a kite.

Finally, the device illustrated in FIG. 3 has a resilient member 38 which is affixed to axle 12. Resilient member 38 has attached to the free end thereof a swivel hook 40 the use of which will become apparent in the ensuing discussion of the use of the device.

OPERATION OF THE PREFERRED EMBODIMENT

Referring now to FIGS. 1 and 2, one can see the use of the preferred embodiment.

FIG. 2 illustrates the control of the kite 24 by the two handles 16 and 18. Subsequent to or upon termination of the flight of kite 24, when it becomes necessary to retrieve the kite lines 20 and 22 respectively, in reference to this FIG. 1 illustrates how this may be done with the preferred embodiment. Assuming that the kite flyer is the right handed, the axle 12 is positioned against the wrist 42 of the user (not shown). The right hand 44 of the user is positioned on the opposite end of axle 12 so that the kite line 20 and 22 may pass over the left hand 46 of the user. It is to be understood that at this time the handles 16 and 18 have been affixed to the rods 30 and 32 in the manner shown in FIG. 3. Retrieval of the lines 20 and 22 is then accomplished by rotating or spinning the axle 12 so that the lines are woundabout the handles 16 and 18 until full retrieval is accomplished. It should be understood that left hand 46 is free to provide the necessary tension to the lines during retrieval. At this point the swivel 40 and the resilient member 38 may be stretched to a certain extent and wound in the opposite direction about handles 16 and 18 so that the ends of the lines 20 and 22 may be affixed to swivel 40. It should be understood that lines 20 and 22 may have some swivel device or the like that permits them to be fixed together forming a loop so that the swivel 40 may assist in holding the respective lines in the retrieved mode.

When it is desired to fly a kite the lines 20 and 22 may be withdrawn from the handles in a manner reverse of the directions just recited and eventually affixed to the kite 24. At that point the handle 16 and 18 may be removed from the axle 12 and the axle 12 put to one side until the kite flying session has come to an end. At this point retrieval should follow in the manner indicated above.

DESCRIPTION OF THE ALTERNATE EMBODIMENT

Referring now to FIG. 5, an alternate embodiment is illustrated having an axle 12' and an axis 14'. The alternate embodiment also includes first and second handles 16' and 18' each having a line 20' and 22' associated therewith in the same manner as the primary embodiment the handles 16' and 18' define axis 26' and 28' respectively. Two elongated members 30' and 32' are associated with axle 12' in the following manner. Elongated member 32 is fixed at one end of axle 12 while elongated rod 30' is fixed to a second portion of axle 12'. Axle 12' is designed so that it may be extended along its axis 14'. This is accomplished by a sleeve and rod arrangement with a resilient member as shown in FIG. 6. Specifically, the right hand portion of axle 12', which is shown partially in section, is surrounded by the left hand portion 48. A compression spring 50 urges the left hand portion of 48 of axle 12' rightwardly onto the center portion of axle 12' to the position shown in FIG. 5. The two elongated members 30' and 32' may be held in this position by any convenient fixture mechanism such as a conventional knurled member 52 which may be affixed on an extended rod portion 54 of axle 12'. When knurled member 52 is unscrewed from the right hand portion 55, which is fixed to elongated member 32'; elongated member 30' may be moved leftwardly as shown in phantom in FIG. 4, handles 16' and 18' may then be removed from the framework formed by axle 12' and elongated members 30' and 32'. It should be understood that handles 16' and 18' are mounted between elongated members 30' and 32' by means of pins or the like such as pin 56 which are adapted to fit into pre-drilled holes on the inner sides or the ends of handles 16' and 18'.

The alternate embodiment in FIG. 4 also includes a crank handle 58 which is fitted to elongated member 32' at a point off the axis of axle 12'. This facilitates holding handle 53 while cranking the assembly with crank handle 58 to retrieve the lines 20' and 22'. It should be understood that in this embodiment a second person may assist or the retrieval operation could take place while the kite is still flying so that tension is maintained on lines 20' and 22'. Alternatively handle 53 could be placed in the crook of one's elbow so that the tension on lines 20' and 22' could be maintained by one's hand while the other hand cranks the device about axis 14'.

The alternate embodiment may also include the resilient member 38 (not shown) and the swivel hook 40 (not shown) which this serves the same purpose as the structure depicted in the primary embodiment.

DESCRIPTION OF THE SECOND ALTERNATE EMBODIMENT

FIG. 4 illustrates a second alternate embodiment which includes an axle 12'' defining an axis 14'' having two elongated members 30'' and 32''. The principle difference between the alternate embodiment shown in FIG. 4 and the primary embodiment is the structure of the handles 16'' and 18''. Since the structure of the two handles is identical, only handle 16'' will be described. Handle 16'' is formed in a U-shape as shown in FIG. 4 wherein the holes used in the primary embodiment are replaced by the curved ends 60 and 62 of the handles and are formed to fit around the elongated members 30'' and 32''. The kite lines 20 and 22 and the swivel hook, while not shown in FIG. 4, should be understood to be a portion of this embodiment in the same manner as they are shown in the primary embodiment illustrated in FIG. 3. The purpose of the handle 16" and 18" is principally to give a control handle shape to the device without sacrificing the inventiveness of the basic invention. It further gives the operator a sense of feel of the direction of the handles. Again cushioning material may be utilized as with the handles illustrated in FIGS. 3 and 5 as the case may be.

OPERATION OF THE ALTERNATE EMBODIMENTS

Operation of the embodiment illustrated in FIG. 4 is the same as the operation of the embodiment described in relation to the device shown in FIG. 3 hence no further discussion is offered. Operation of the device shown in FIG. 5 differs only in that the mounting of the handle 16' and 18' is between the elongated rods 30' and 32' so that the elongated rods 30' and 32' must be moved outwardly to release the handles. It should be understood that the elongated rods 30' and 32' are fixed relative to the axle 12' so that they lie in the same plane. This may be accomplished by making the axle 12' so that it has some noncircular cross-section such as a square or some other regular polygonal shape to avoid rotation of one of the elongated rods relative the other.

While this invention has been described in relation to a particular embodiment, it is to be understood that it is to be limited only so far as the claims appended hereto.

I claim:

1. A control and take-up assembly for use with a multi control line kite comprising:

an axle;

a pair of elongated handles, each having an axis, each handle having affixed thereto at least one of the control lines;

means for temporarily affixing said elongated handles to said axle to form a take-up assembly such that the axes of said handles are substantially parallel to the axis of said axle, and the handles laterally displaced on opposite sides of said axis of said axle a distance at least equal to the radius of said axle.

2. The device of claim 1 wherein the means for affixing said handles to said axle comprises first and second of elongated rods fixed to said axle normal to the axis of said axle and such that the first and second rods lie in the same plane; and said handles adapted to be removably mountable on said rods.

3. The device of claim 2 further comprising:

a swivel hook; and a relatively short length of resilient material forming a resilient member and fixed at one end to said axle, said swivel hook affixed to said resilient member at the other end thereof, said swivel hook and resilient member for fixing said handles and the control lines to the device.

4. The device of claim 1 wherein each of said handles further includes a resilient cushioning material affixed to the outer surface thereof.

5. The device of claim 2 wherein each of said handles has formed therein a pair of holes, said holes separated by a distance equal to the separation of said first and second rods, the axis of each of said holes lying in the same plane and perpendicular to the axis of said respective handles, such that said handles may be removably mounted on said elongated rods.

6. The device of claim 2 wherein said first rod is slidably affixed to said axle at one end thereof and further wherein said handles are mountable between said first and second rods while both said rods are affixed to said axle.

7. The device of claim 6 further including a crank handle affixed to said first rod, the axis of said crank handle parallel to but removed from the axis of said axle a sufficient distance to permit said crank handle to form a crank so that the entire device may be easily rotated about the axis of said axle.

8. The device of claim 7 wherein said crank handle includes a rotatable sleeve formed thereabout.

9. The device of claim 8 wherein said axle extends beyond the second rod further including a second rotatable sleeve formed about said axle on the portion extending beyond the second rod.

10. The device of claim 9 wherein each of said handles further includes a resilient cushioning material affixed to the outer surface thereof.

11. The device of claim 10 further including:

a swivel hook; and a relatively short length of resilient material forming a resilient member and fixed at one end to said axle, said swivel hook affixed to said resilient member at the other end thereof, said swivel hook and resilient member for fixing said handles and the control lines to the device.

12. The device of claim 2 wherein each of said handles is formed in a U-shape and having a U-shaped cross section, each adapted to be removably mounted between the first and second elongated rods.

13. The device of claim 12 further including:

a swivel hook; and a relatively short length of resilient material forming a resilient member fixed at one end to said axle, said swivel hook fixed to said resilient member at the other end thereof, said swivel hook and resilient member for fixing said handles and the control lines to the device.

14. The device of claim 13 wherein each of said handles further includes a resilient cushioning material affixed to the outer surface thereof.

15. A control and take-up assembly for use with a multi control line kite comprising:

an axle;

a pair of elongated handles, each having an axis, each handle having affixed thereto at least one of the control lines;

means for temporarily affixing said elongated handles to said axle to form a take-up assembly such that the axes of said handles are substantially parallel to the axis of said axle, and the handles displaced on opposite sides of said axle a distance at least equal to the radius of said axle;

wherein the means for affixing said handles to said axle comprises first and second of elongated rods fixed to said axle normal to the axis of said axle and such that the first and second rods lie in the same plane; and wherein each of said handles has formed therein a pair of holes, said holes separated by a distance equal to the separation of said first and second rods, the axis of each of said hole lying in the same plane and perpendicular to the axis of said respective handle such that said handles may be removably mounted on said elongated rods.

16. A control and take-up assembly for use with a multi control line kite comprising:

an axle;

a pair of elongated handles, each having an axis, each handle having affixed thereto at least one of the control lines;

means for temporarily affixing said elongated handles to said axle to form a take-up assembly such that the axes of said handles are substantially parallel to the axis of said axle, and the handles displaced on opposite sides of said axle a distance at least equal to the radius of said axle;

wherein the means for affixing said handles to said axle comprises first and second of elongated rods fixed to said axle normal to the axis of said axle and such that the first and second rods lie in the same plane; and wherein said first rod is slidably affixed to said axle at one end thereof and further wherein said handles are mountable between said first and second rods while both said rods are affixed to said axle.

17. A control and take-up assembly for use with a multi control line kite comprising:

an axle;

a pair of elongated handles, each having an axis, each handle having affixed thereto at least one of the control lines;

means for temporarily affixing said elongated handles to said axle to form a take-up assembly such that the axes of said handles are substantially parallel to the axis of said axle, and the handles displaced on opposite sides of said axle a distance at least equal to the radius of said axle;

wherein the means for affixing said handles to said axle comprises first and second of elongated rods fixed to said axle normal to the axis of said axle and such that the first and second rods lie in the same plane; and said handles formed in a U-shape and having a U-shaped cross section, each adapted to be removably mounted between the first and second elongated rods.

* * * * *